US005149609A

United States Patent [19]

Yu et al.

[11] Patent Number: 5,149,609

[45] Date of Patent: Sep. 22, 1992

[54] POLYMERS FOR PHOTORECEPTOR OVERCOATING FOR USE AS PROTECTIVE LAYER AGAINST LIQUID XEROGRAPHIC INK INTERACTION

[75] Inventors: Robert C. U. Yu; John W. Spiewak, both of Webster; Deborah Nichol-Landry, Rochester, all of N.Y.

[73] Assignee: Xerox Corporation, Stamford, Conn.

[21] Appl. No.: 627,338

[22] Filed: Dec. 14, 1990

[51] Int. Cl.[5] ..... G03G 5/04

[52] U.S. Cl. ..... 430/58; 430/56; 430/59

[58] Field of Search ..... 430/58, 59, 56

[56] References Cited

U.S. PATENT DOCUMENTS 4,062,681 12/1977 Lewis et al. ..... 96/1.5 N
4,181,526 1/1980 Blakey et al. ..... 430/67
4,260,671 4/1981 Merrill ..... 430/67
4,265,990 5/1981 Stolka et al. ..... 430/59
4,390,609 6/1983 Wiedemann ..... 430/58
4,415,639 11/1983 Horgan ..... 430/57
4,784,928 11/1988 Kan et al. ..... 430/58
5,021,309 6/1991 Yu ..... 430/58

*Primary Examiner*—Marion E. McCamish
*Assistant Examiner*—Mark A. Chapman
*Attorney, Agent, or Firm*—Kenyon & Kenyon

[57] ABSTRACT

A protective overcoating layer for an electrophotographic imaging device prevents crystallization and leaching of hole transport compounds in a charge transport layer of the imaging device. The overcoat also prevents solvent and ink contact/bending stress charge transport layer cracking. The overcoating layer contains a polyester homopolymer which contains a hole transporting compound and an aliphatic diol in the polymer chain backbone. The homopolymer can be either a meta or para hole transport compound ester linkage polyester homopolymer.

19 Claims, 1 Drawing Sheet

POLYMERS FOR PHOTORECEPTOR OVERCOATING FOR USE AS PROTECTIVE LAYER AGAINST LIQUID XEROGRAPHIC INK INTERACTION

BACKGROUND OF THE INVENTION

In electrophotography, an electrophotographic plate containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support such as paper. This imaging process may be repeated many times with reusable photoconductive insulating layers.

An electrophotographic imaging member may have a number of forms. For example, the imaging member may be a homogeneous layer of a single material such as vitreous selenium or may be a composite layer containing a photoconductor and another material. One type of composite imaging material comprises a layer of finely divided particles of a photoconductive inorganic compound dispersed in an electrically insulating organic resin binder. U.S. Pat. No. 4,265,990 discloses a layered photoreceptor having separate photogenerating and charge transport layers. The photogenerating layer is capable of photogenerating holes and injecting the photogenerated holes into the charge transport layer.

Other composite imaging members have been developed having numerous layers which are highly flexible and exhibit predictable electrical characteristics within narrow operating limits to provide excellent images over thousands of cycles. One type of multilayered photoreceptor that has been employed as a belt in electrophotographic imaging systems comprises a substrate, a conductive layer, a hole blocking layer, an adhesive layer, a charge generating layer, and a charge transport layer. This photoreceptor may also comprise additional layers such as an anti-curl back coating and an overcoating layer. A description of the layers of an electrophotographic imaging member having many layers follows.

The Supporting Substrate

The supporting substrate may be opaque or substantially transparent may contain numerous suitable materials having the required mechanical properties. The substrate may further have an electrically conductive surface. The substrate may have a layer of an electrically non-conductive or conductive material such as an inorganic or an organic composition. Various resins including polyesters, polycarbonates, polyamides and polyurethanes, which are known for their non-conductivity, may be used. The electrically insulating or conductive substrates should be flexible and may have any number of different configurations, e.g., a sheet, a scroll, and an endless flexible belt. Preferably, the substrate is an endless flexible belt and comprises a commercially available biaxially oriented polyester known as Mylar, available from E. I. du Pont de Nemours & Co., or Melinex, available from ICI Americas Inc. or Hostaphan, available from American Hoechst Corporation. Alternatively, the substrate may be a rigid drum.

The thickness of the substrate layer depends on numerous factors, including mechanical performance and economic considerations. The thickness of this layer may range from about 65 micrometers to about 150 micrometers, and preferably from about 75 micrometers to about 125 micrometers for optimum flexibility and minimum induced surface bending stress when cycled around small diameters rollers, e.g., 19 millimeter diameter rollers. The flexible belt substrate may be of substantial thickness, for example, over 150 micrometers, or of minimum thickness, for example, less than 500 micrometers, provided there are no adverse effects on the final photoconductive imaging member.

The Electrically Conductive Ground Plane Layer

The electrically conductive ground plane layer may be an electrically conductive metal which may be formed on the substrate by any suitable coating technique, e.g., vacuum depositing. Typical metals include aluminum, zirconium, niobium, tantalum, vanadium, hafnium, titanium, nickel, stainless steel, chromium and tungsten. This layer may substantially vary in thickness depending on the optical transparency and flexibility desired for the electrophotoconductive member. For example, if the imaging member is a flexible photoresponsive imaging member, then the thickness of the conductive layer may be between about 20 Angstroms to about 750 Angstroms, and more preferably from about 50 Angstroms to about 200 Angstroms to achieve an optimum combination of electrical conductivity, flexibility and light transmission.

A thin layer of metal oxide forms on the outer surface of most metals when they are exposed to air, regardless of the technique used to form the metal layer. Thus, when other layers overlying the metal layer are characterized as "contiguous" layers, it is intended that these overlayering contiguous layers may be in contact with a thin metal oxide layer that has already been formed on the outer surface of the oxidizable metal layer.

The conductive ground plane layer may also vary in light transparency depending on the desired quality of the imaging member. Generally, for rear erase exposure, a conductive layer light transparency of at least about 15% is desirable. The conductive layer may not be limited to metals. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The Charge Block Layer

After the electrically conductive ground plane layer is deposited, the charge blocking layer may then be deposited. Charge blocking layers for positively charged photoreceptors allow holes from the imaging surface of the photoreceptor to migrate towards the conductive layer. Any suitable hole blocking layer capable of forming to the opposite photoconductive layer may be used in a negatively charged photoreceptor. The hole blocking layer may include polymers such as polyvinylbutyral, epoxy resins, polyesters, polysiloxanes, polyamides and polyurethanes, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si()CH_3)_2$, (gamma-aminobutyl) methyl diethoxysilane, and $H_2N(CH_2)_3]CH_3Si(OCH_3)_2$ (gamma-aminopropyl) methyl diethoxysilane, as disclosed in U.S. Pat. Nos. 4,338,387, 4,286,033 and 4,291,110.

A preferred hole blocking layer comprises a reaction product between a hydrolyzed silane or mixtures of hydrolyzed silanes and the oxide surface of a metal ground plane layer. The oxide surface inherently forms on the outer surface of most metal ground plane layers when they are exposed to air after deposition. This combination enhances electrical stability at low RH. Hydrolyzed silanes have the general formula:

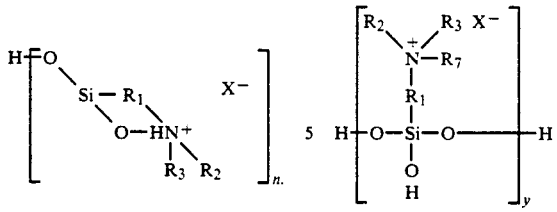

wherein $R_1$ is an alkylidene group containing one to 20 carbon atoms, $R_2$, $R_3$ and $R_7$ are independently selected from the group consisting of H, a lower alkyl group containing one to three carbon atoms and a phenyl group, X is an anion of an acid or acidic salt, N is 1–4, and Y is 1–4. The imaging member is preferably prepared by depositing on the metal oxide layer of a metal conductive layer, a coating of an aqueous solution of the hydrolyzed aminosilane at a pH between about 4 and about 10, drawing the reaction product to form a siloxane film, applying an adhesive layer, and thereafter applying electrically operative layers such as a photogenerator layer and a hole transport layer to the adhesive layer.

The hole blocking layer should be continuous and have a thickness of less than about 0.5 micrometers because greater thicknesses may lead to undesirable high residual voltage. A hole blocking layer having thickness between about 0.005 micrometers and about 0.3 micrometers is preferred because charge neutralization after the exposure step is facilitated and optimum electrical performance is achieved. A thickness of between about 0.03 micrometers and 0.06 micrometers is especially preferred for the hole blocking layer to achieve optimum electrical behavior. The blocking layer may be applied by any suitable conventional technique, e.g., spraying, dip coating, draw bar coating, gravure coating, silk screening, air knife coating, reverse roll coating, vacuum deposition, and chemical treatment. Thin layers can be easily obtained by applying the blocking layer in dilute solution form then removing the solution after deposition of the coating by conventional techniques such as vacuum deposition or heating. Generally, a weight ratio of the hole blocking layer material to solvent of between about 0.05:100 to about 0.5:100 is satisfactory for spray coating.

The Adhesive Layer

In most cases, intermediate adhesive layers between the injection blocking layer and the adjacent charge generating or photogenerating layer may be desired. If such layers are utilized, preferably they have a dry thickness between about 0.001 micrometers to about 0.2 micrometers. Typical adhesive layers include film-forming polymers such as copolyester, du Pont 49,000 resin (available from E. I. du Pont de Nemours & Co.), Vitel PE-I00 (available from Goodyear Rubber & Tire Co.), polyvinylbutyral, polyvinylpyrolidone, polyurethane and polymethyl methacrylate.

The Charge Generating Layer

A suitable charge generating (photogenerating) layer may be applied to the adhesive layer. Examples of photogenerating layers include inorganic photoconductive particles such as amorphous selenium, trigonal selenium, selenium alloys selected from the group consisting of selenium-tellurium, selenium-tellurium-arsenic and selenium arsenide, phthalocyanine pigments such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from du Pont under the tradename Monastral Red, Monastral Violet and Monastral Red Y, and Vat orange 1 and Vat orange 3 (tradenames for dibromo anthanthrone pigments), benzimidazole perylene, substituted 2,4-diamino-triazines as disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange. The particles are dispersed in a film forming polymeric binder. Multi-photogenerating layer compositions may be utilized where a photoconductive layer enhances or reduces the properties of the photogenerating layer. Examples of multiphotogenerating layer image members are described in U.S. Pat. No. 4,415,639. Other suitable photogenerating materials known in the art may also be utilized. Charge generating layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and mixtures thereof, are especially preferred of their sensitivity to white light. Vanadyl phthalocyanine, metal free phthalocynanine and tellurium alloys are also preferred because these materials are also sensitive to infrared light.

Any suitable polymeric film forming binder material may be employed as the matrix in the photogenerating binder layer. Typical polymeric film forming materials include those described in U.S. Pat. No. 3,121,006.

The photogenerating composition or pigment is present in the resinous binder composition in various amounts. Generally from about 5% by volume to about 90% by volume of the photogenerating pigment is dispersed in about 10% by volume to about 90% by volume of the resinous binder. Preferably, from about 20% by volume to about 30% by volume of the photogenerating pigment is dispersed in about 70% by volume to about 80% by volume of the resinous binder composition.

The photogenerating layer generally ranges in thickness from about 0.1 micrometers to about 5.0 micrometers, preferably from about 0.3 micrometers to about 3.0 micrometers. The photogenerating layer thickness is related to the binder contents. Higher binder content compositions generally require thicker layers. Thicknesses outside these ranges can be selected if layers of greater thickness achieve the objectives of the present invention. Any suitable and conventional technique for mixing and coating the photogenerating layer mixture onto the previously dried adhesive layer may be used. Typical application techniques include spraying, dip coating, roll coating, and wire wound rod coating. The deposited coating may be dried by any suitable conventional technique such as oven drying, infrared radiation drying, air drying, or vacuum drying.

The Active Charge Transport Layer

The active charge transport layer may comprise any suitable transparent organic polymer or non-polymeric material capable of supporting the injection of photogenerated holes and electrons from the charge generating layer and allowing the transport of these holes or electrons through the organic layer to selectively discharge the surface charge. The active charge transport layer not only serves to transport holes or electrons but also protects the photoconductive layer from abrasion or chemical attack and therefore extends the operating life of the photoreceptor imaging member. The charge transport layer should exhibit negligible, if any, discharge when exposed to a wavelength of light useful in xerography, i.e., 4000 Angstroms to 9000 Angstroms. The charge transport layer is substantially transparent to radiation in a region in which the photoconductor is to be used. The CTL is comprised of a material which supports the injection of photogenerated holes from the charge generator layer. The active charge transport layer is normally transparent when exposure is effective therethrough to ensure that most of the infinite radiation is utilized by the underlying charge generating layer. When used with a transparent substrate, image wise exposure or erase may be accomplished through the substrate. with all light passing through the substrate. In this case, active charge transport material need not transmit light in the wavelength region of use. The charge transport layer in conjunction with the charge generating layer is an insulator to the extent that an electrostatic charge placed on the charge transport layer is not conductive in the absence of illumination. The active charge transport layer may comprise activating compounds dispersed in normally electrically inactive compounds. These compounds may be added to polymeric materials which are incapable of supporting the injection of photogenerating holes and incapable of allowing the transport of these holes. An especially preferred transport layer employed in multilayer photoconductors comprises from about 25% to about 75% by weight of at least one charge transporting aromatic amine compound, and about 75% to 25% of a polymeric film forming resin in which the aromatic amine is soluble.

The charge transport layer is preferable formed from a mixture of an aromatic amine compound of one or more compounds having the general formula:

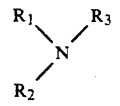

wherein $R_1$ and $R_2$ are aromatic groups selected from the group consisting of substituted or unsubstituted phenyl group, naphthyl group, and polyphenyl group and $R_3$ is selected from the group consisting of a substituted or unsubstituted aryl group, alkyl groups having one to eighteen carbon atoms, and cycloaliphatic compounds having from three to eighteen carbon atoms. The substitutes should be free of electron withdrawing groups such as $NO_2$ groups and CN groups. Typical aromatic amines compounds that are represented by this structural formula include:

i. Triphenyl amines such as:

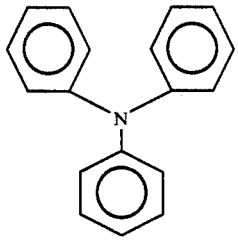

ii. Bis and polytriarylamines such as:

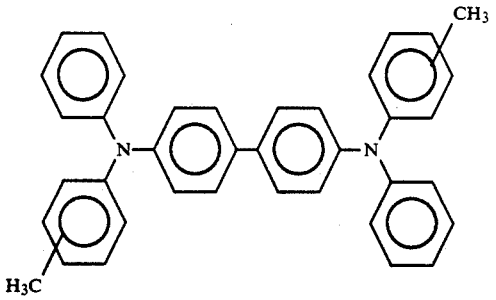

iii. Bis arylamine ethers such as:

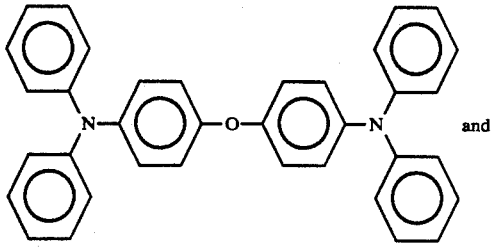

and iv. Bis alkyl-arylamines such as:

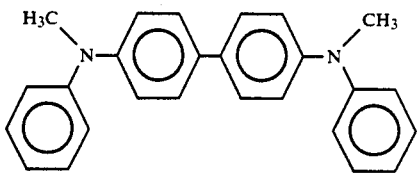

A preferred aromatic amine compound has the general formula:

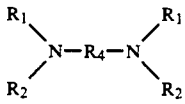

wherein $R_1$ and $R_2$ are defined above and $R_4$ is selected from the group consisting of a substituted or unsubstituted biphenyl group, diphenyl ether group, alkyl group having from one to eighteen carbon atoms, and cycloaliphatic group having from three to twelve carbon atoms. The substitutes should be free of electron withdrawing groups such as $NO_2$ groups and CN groups.

Examples of charge transporting aromatic amines represented by the structural formula of above include triphenylmethane, bis (4-diethylamine-2-methylphenyl)phenylmethane; 4'-4''-bis(diethylamino)-2'2''-dimethyltriphenylmethane; N,N'-bis(alkylphenyl)-[1,1'-biphenyl]-4,4'-diamine wherein the alkyl is, for example, methyl, ethyl, propyl or N-butyl; N,N'-diphenyl-N,N'-bis(3''methylphenyl)-(1.1'biphenyl)-4,4'-diamine. The amines are dispersed in an inactive resin binder.

Any suitable inactive resin binder in which the charge transfer molecules are soluble or molecularly dispersed in methylene chloride or other suitable solvents may be employed. Typical inactive resin binders soluble in methylene chloride include polycarbonate resin, polyvinylcarbazole, polystyrene, polyester, polyarylate, polyacrylate, polyether and polysulfone. Molecular weights can vary from about 20,000 to about 1,500,000. Other solvents that dissolve these binders include tetrahydrofurane, toluene, trichloroethylene, 1,1,2-trichloroethane, and 1,1,1-trichloroethane.

The preferred electrically inactive resin materials are polycarbonate resins having a molecular weight from about 20,000 to about 120,000, more preferably from about 50,000 to about 100,000. The materials most preferred as the electrically inactive resin materials are poly(4,4'-dipropylidene-diphenylene carbonate) having a molecular weight from about 35,000 to about 40,000, available as Lexan 145 from General Electric Company; poly(4,4'-isopropylidene-diphenylene carbonate) with a molecular weight from about 40,000 to about 45,000, available as Lexan 141 from General Electric Company; a polycarbonate resin having a molecular weight of from about 50,000 to about 100,000, available as Makrolon from Farben Fabricken Bayer A. G.; a polycarbonate resin having a molecular weight of from about 20,000 to about 50,000, available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components as it has a low boiling point.

An especially preferred multilayered photoconductor comprises a charge generating layer comprising a binder layer of photoconductive material and a contiguous hole transport layer of a polycarbonate resin material having a molecular weight of from about 20,000 to about 120,000 and having dispersed therein from about 25% to 75% by weight of one of more compounds having the general formula:

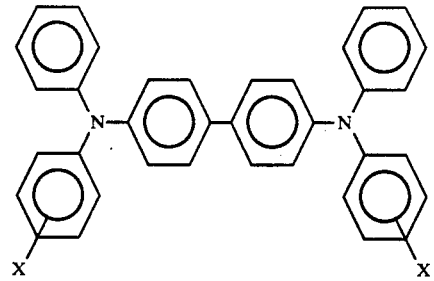

wherein X is selected from the group consisting of an alkyl group having from one to four carbon atoms and chlorine. The photoconductive layer exhibits the capability of hole photogeneration and injection of the generated holes. The hole transport layer is substantially non-absorbing in the spectral region at which the photoconductive layer generates and injects the photogenerating holes, but the hole transport layer is capable of supporting the injection of photogenerating holes from the photoconductive layer and transporting the holes.

The thickness of the charge transport layer may range from about 10 micrometers to about 50 micrometers, preferably from about 20 micrometers to about 35 micrometers. A range from about 23 micrometers to about 31 micrometers is optimal.

The Ground Strip

The ground strip may comprise of film forming polymer binder and electrically conductive particles. Cellulose may be added to disperse the electrically conductive particles. Any suitable electrically conductive particles may be used in the electrically conductive ground strip layer. The ground strip layer may comprise materials which include those disclosed in U.S. Pat. No. 4,664,995. Typical electrically conductive particles include carbon black, graphite, copper, silver, gold, nickel, tantalum, chromium, zirconium, vanadium, niobium, indium, and tin oxide. The electrically conductive particles may have any suitable shapes such as irregular, granular, spherical, elliptical, cubic, flake, and filament. Preferably, the electrically conductive particles should have a particular size less than the thickness of the electrically conductive ground strip layer to avoid an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The thickness of the ground strip layer is generally from about 7 micrometers to about 40 micrometers. A preferred thickness may range from about 13 micrometers to about 28 micrometers, and more preferably from about 16 micrometers to about 24 micrometers.

The Anti-Curl Layer

The anti-curl layer may comprise organic polymers or inorganic polymers that are electrically insulating or slightly semi-conductive. The anti-curl layer provides flatness and/or abrasion resistance. An anti-curl layer may be formed at the back side of the substrate, opposite the imaging layers. The anti-curl layer may comprise a film forming resin and a adhesive promoter polyester additive.

Examples of the film forming resins include polyacrylate, polystyrene, poly(4,4'-isopropylidene diphenyl carbonate), and 4,4'-cyclohexylidene diphenyl polycarbonate. Typical adhesion promoters used as additives include 49,000 (du Pont), Vitel PE-100, Vitel PE-200, Vitel PE-307 (Goodyear). Usually from about one to about 8 weight percent adhesion promotor is selected for film forming resin addition. The thickness of the anti-curl layer is from about 3 micrometers to about 30 micrometers and preferably about 14 micrometers.

Imaging members such as those described above are generally exposed to repetitive electrophotographic cycling which subjects exposed layers of imaging devices to abrasion, chemical attack, heat and multiple exposure to light. This repetitive cycling leads to a gradual deterioration in the mechanical and electrical characteristics of the exposed layers. For example, repetitive cycling has adverse effects on exposed portions of the imaging member. Attempts have been made to overcome these problems. However, the solution of one problem often leads to the creation of additional problems.

In electrophotographic imaging devices, the charge transport layer may comprise a high loading of a charge transport compound dispersed in an appropriate binder. The charge transport compound may be present in an amount greater than about 35% based on the weight of the binder. For example, the charge transport layer may comprise 50% of a charge transport compound in about 50% binder. A high loading of charge transport compound appears to drive the chemical potential of the charge transport layer to a point near the metastable state, which is a condition that induces crystallization, leaching and stress cracking when placed in contact with a chemically interactive solvent or ink. Photoreceptor functionality may be completely destroyed when a charge transport layer having a high loading of a charge transport molecule is contacted with liquid ink. It is thus desirable to eliminate charge transport molecule crystallization, leaching, and solvent-stress charge transport layer cracking.

Another problem in multilayered belt imaging systems includes cracking in one or more critical imaging layers during belt cycling over small diameter rollers. Cracks developed in the charge transport layer during cycling are a frequent phenomenon and most problematic because they manifest themselves as print-out defects which adversely effect copy quality. Charge transport layer cracking has a serious impact on the versatility of a photoreceptor and reduces its practical value for automatic electrophotographic copiers, duplicators, and printers.

Another problem encountered with electrophotographic imaging members is corona species induced deletion in print due to degradation of the charge transport compounds by chemical reaction with corona species. During electrophotographic charging, corona species, e.g., ozone, nitrogen oxides and acids are generated. A number of overcoating layers have been proposed for various purposes.

U.S. Pat. No. 4,784,928, Kan et al. discloses a reusable electrophotographic element comprising first and second charge transport layers. The second charge transport layer has irregularly shaped fluorotelomer particles, an electrically non-conductive substance, dispersed in a binder resin. The second charge transport layer allows for toner to be uniformly transferred to a contiguous receiver element with minimal image defects.

U.S. Pat. No. 4,260,671 to Merrill discloses various polycarbonate overcoats which provide an increased resistance to solvents and abrasions.

U.S. Pat. No. 4,390,609 to Wiedemann discloses a protective transparent cover layer made of an abrasion-resistant binder composed of polyurethane resin and a hydroxyl group containing polyester or polyether, and a polyisocyanate.

U.S. Pat. No. 4,062,681 to Lewis et al. discloses a polymeric overcoat comprising a homopolymer, copolymer or blend thereof and an unsaturated carboxylic acid or a partial alkyl ester and a highly cross-linking agent.

U.S. Pat. No. 4,I8I,526 to Blakely et al. discloses an overcoat for electrophotographic elements comprising a polymer having repeating units and a cross-linking agent. The crosslinking occurs at active carboxyl groups and/or methylene groups within the polymer.

There continues to be a need for improved overcoats for electrophotographic imaging members. The overcoats will provide better protection for the charge transport layer from adverse mechanical and chemical induced effects.

SUMMARY OF THE INVENTION

The present invention overcomes the shortcomings of the prior art by providing a protective overcoating layer for a charge transport layer. The overcoat layer prevents crystallization and leaching of hole transport compound from the charge transport layer while also effectively preventing stress cracking of the charge transport layer upon exposure to liquid xerographic ink, solvent ink carrier, or chemical vapor. The overcoating layer of the present invention comprises a homopolymer which has inherent hole transport capability and also acts as an extension to the charge transport layer to provide a barrier against ink, solvent, corona species, and chemical attacks. It may be of one of the following types:

(1) a homopolymer consisting of a hole transport compound and an aliphatic diol in the chain backbone, (2) a copolymer of a hole transport compound linked to a urethane, (3) a fluorine-based pendant active moiety functional polymer of a polyester, polycarbonate, or polyurethane, and (4) an organo-polyphosphazene having hole transport pendant groups.

The preferred thickness of the overcoating layer ranges from about 3 micrometers to 6 micrometers.

DETAILED DESCRIPTION

Figure 1:
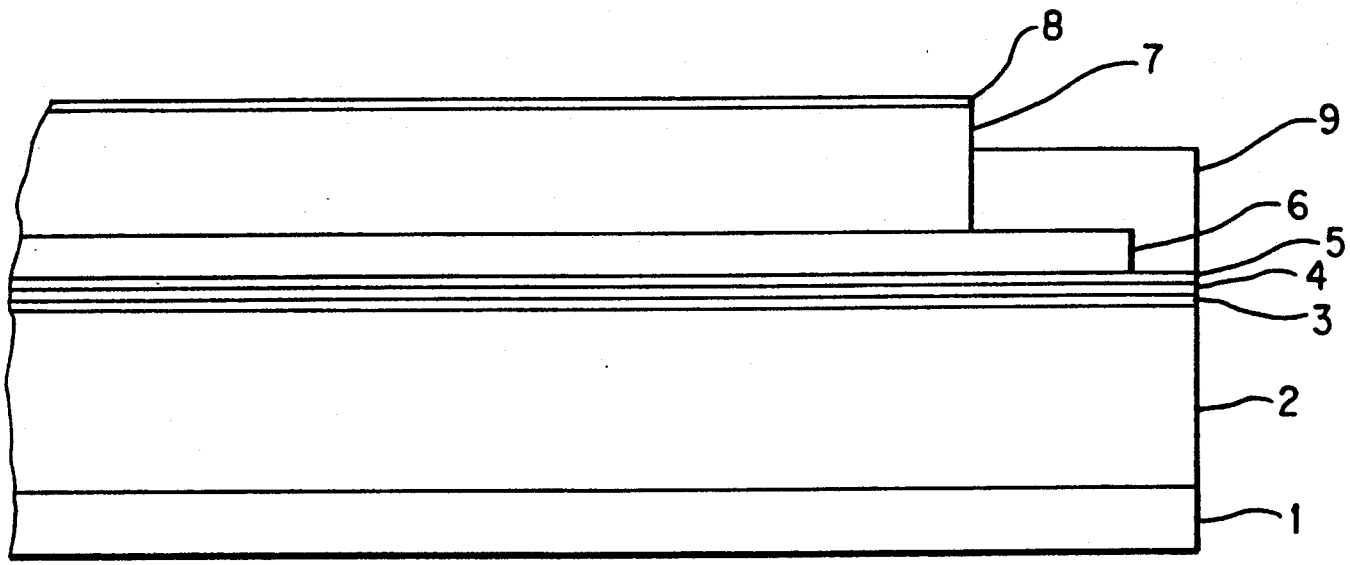
FIG. 1 is a cross-sectional view of an electrographic imaging member constructed according to an embodiment of the present invention.

The protective overcoating of the present invention may be applied to a charge transport layer of an electrophotographic imaging member having any number of configurations. For example, the electrophotographic imaging member to be overcoated may have at least one imaging layer capable of retaining an electrostatic latent image and a supporting substrate layer having an electrically conductive surface. At least one of the imaging layers may in turn have a charge transport layer and a charge generating layer. The imaging device may further comprise additional layers such as a blocking layer, an adhesive layer, and an anti-curl layer.

FIG. 1 illustrates the structure of an electrophotographic imaging member. The imaging member of FIG. 1 has an anti-curl layer 1, a supporting substrate 2, an electrically conductive ground plane layer 3, a hole blocking layer 4, an adhesive layer 5, a charge generating layer 6, and a charge transport layer 7. An overcoating layer 8 is also shown in FIG. 1.

In the above-described imaging member, a ground strip 9 may be provided adjacent to the charge transport layer at an outer edge of imaging member. Such a ground strip is disclosed in U.S. Pat. No. 4,664,995. The ground strip 9 is coated adjacent to the charge transport layer so as to provide grounding contact with a grounding device (not shown) during electrophotographic processes.

According to the present invention, a protective overcoating layer is provided over the charge transport layer. The protective overcoating layer of the present invention comprises a polyester homopolymer having the ester linkage to either the meta or para position of the hole transport compound. The molecular structure of the polyester homopolymer showing the ester meta linkage is given below:

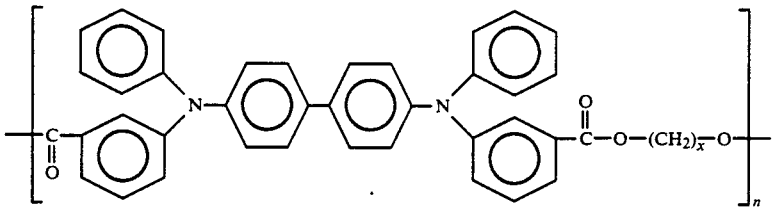

while that having the para linkage is as follows:

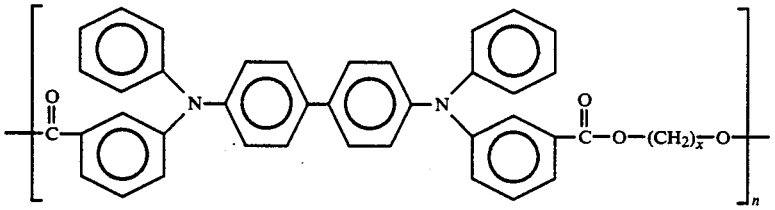

where x=2 to 20

The meta ester linkage having a $C_{10}$ diol polyester homopolymer is poly[oxydecamethyleneoxy-N,N'-diphenyl-N,N'bis(3-carbonylphenyl)benzidine]. A para ester linkage $C_{10}$ diol is poly[oxydecamethyleneoxy-N,N'-diphenyl-N,N'-bis(4-carbonylphenyl)benzidine].

Other single component hole transporting polymers effective as overcoatings may also be selected from the group consisting of a hole transport compound-urethane copolymer, a fluorine-based pendant active moiety of a polyester, a fluorine-based active moiety polycarbonate and a fluorine-based active moiety polyurethane.

Additionally, new class polymers such as organopolyphosphazenes may also be used as overcoats for electrophotographic imaging members. These organopolyphosphazenes have the following structures:

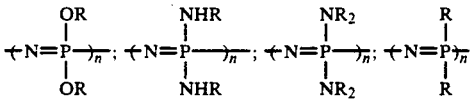

wherein R is selected from a pendant group having hole transport capability.

The synthesized polyester homopolymer of the present invention was used as a protective overcoat for electrophotographic imaging members. The overcoating layer may be applied by any of a number of application methods. Typical application methods may include, for example, hand coating, spray coating and web coating. Drying of the applied overcoating may be effected by any suitable conventional technique such as oven drying, infared radiation drying, and air drying.

Overcoatings of about 3 micrometers to about 10 micrometers applied onto the charge transport layers of the electrophotographic imaging members were effective in preventing charge transport compound leaching, crystallization and charge transport layer stress cracking after prolonged liquid xerographic ink (or mineral oil)/sample contact by static-bend sample parking over a 19 mm diameter roll. Preferably, a layer having a thickness of about 3 micrometers to about 6 micrometers could be employed to give optimum results because the degree of charge transport layer cracking and charge transport compound leaching in the control electrophotographic imaging member (i.e., having no overcoating) was largely dependent on the chemical interactivity between the dispersed hole transport compound and the contacting solvent. The imaging device containing the overcoat layer of the present invention showed no cracking because the hole transport compound was chemically bonded to the $C_{10}$ diol in the chain backbond of the polyester homopolymer. The transport compound was essentially an integral part of the polyester overcoat layer, unlike the charge transport layer in which the hole transport compound was being homogeneously dispersed in a film forming polycarbonate binder.

The invention will be further illustrated in the following, non-limitative examples, it being understood that these examples are intended to be illustrative only and that the invention is not intended to be limited to the materials, conditions, process parameters recited herein.

EXAMPLE I

The synthesis of the polyester homopolymer, poly [oxydecamethyleneoxy-N,N'-diphenyl-N,N'bis(3-carbonylphenyl) benzidine], as described by the molecular structure below:

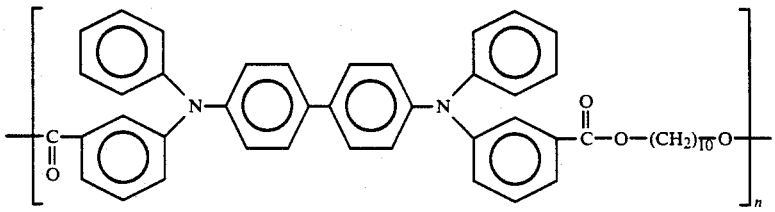

where n is the degree of polymerization, was carried-out by the following steps:

A. Preparation Of Bistriarylamine Monomer: N,N'-Diphenyl-N,N'-Bis(m-Dicarbomethoxylphenyl)Benzidine Via An Ullmann Condensation To a 4 neck 500 ml. round bottom flask equipped with a mechanical stirrer, a thermometer, an Argon inlet tube, and a water-colled condenser on top of which was fixed an Argon outlet tube (to a mineral oil bubbler) was charged 35.3 grams (0.105 mole) of N,N'-diphenylbenzidine, 82.4 grams (0.314 mole) of vacuum distilled methyl m-iodobenzoate, 57.94 grams (0.419 mole) anhydrous potassium carbonate, 31.4 grams (0.494 gram-atom) of Copper bronze (Fisons organic synthesis grade), and 85 mls. of Soltrol ®170 (Phillips Petroleum, b.p. 210°-230° C.) as a diluent for the solid reactants. The reaction vessel was purged with Argon to remove the bulk of the absorbed oxygen while mechanically stirring the solid bronze-colored paste for about 30 minutes. Thereafter a very gentle Argon flow (a blanket) and slow mechanical stirring was maintained over the heated reaction contents until workup of the cooled reaction mixture.

Heating was provided with a heating mantle controlled by a voltage regulated rheostat. In the first 20 minutes, the internal reaction temperature of the bronze paste was increased from room temperature to 198° C. using a voltage setting of 100 volts for the first 10 minutes and 80 volts for the second 10 minutes. Without changing the voltage setting or any other reaction condition variables affecting temperature, the reaction mixture exothermed to 221° C. in the next 7 minutes and finally to 229° C. in another 7 minutes wherein the voltage to the heating mantle was actually decreased to 70 volts in the second 7 minute heating period. This temperature-voltage profile is indicative of a reaction exotherm characteristic of this Ullmann condensation. The voltage was further decreased to 65 volts and after an additional 20 minutes the temperature dropped to 219° C. The temperature was held in the 204°-213° C. range for an additional 21 hours at voltage settings of about 70-77 volts.

After extinguishing the heat source, the reaction contents were ambiently cooled to about 40°-50° C. and 200 mls. of benzene (same yield obtained with methylene chloride used in place of benzene) were added and the mixture was refluxed with gentle mechanical stirring. This stirred extraction was repeated a second time. The combined benzene filtrates were dried over anhydrous magnesium sulfate. The magnesium sulfate was removed by vacuum filtration, and the filtrate was roto-evaporated to give a light yellow solid and a liquid (high boiling Soltrol ®170) phase. After at least overnight refrigeration of this mixture, the liquid was easily decanted from the solid cake adhered to the bottom of the flask. In this way the bulk, but not all, of the Soltrol ®170 was removed. The solid was twice extracted with 100 mls. of refluxing ether (1 hour each) to extract lower molecular weight organic materials but not the product, which is largely insoluble in ethyl ether. After the final vacuum filtration, 42.4 grams (67% yield) of N,N'-diphenyl-N,N'-bis(m-dicarbomethoxyphenyl)benzidine was obtained having m.p. 136°-141° C. The broad melting point range is due to the presence of Soltrol ®170 components, which are generally $C_{13}$ to $C_{15}$ aliphatic hydrocarbon compounds that are chemically inert in the melt polycondensation of this monomer with aliphatic diols.

The methyl m-iodobenzoate was prepared from the corresponding carboxylic acid as follows. Esterification of m-iodobenzoic acid (100 grams; 0.403 mole) was carried out in 800 mls. of reagent grade methanol as solvent and reactant. The 1 liter round bottom flask was equipped with a magnetic stirring football, an HCl inlet tube, and a water cooled reflux condenser. Gaseous hydrogen chloride was bubbled into the stirred reaction solution for about 3 hours, and the solution warmed from room temperature to a gentle reflux. The HCl saturated solution was next refluxed (64° C.) for 48 hours after which time the solution was cooled in an ice-ice water bath for 2.5 hours affording a coloress solid which was readily vacuum filtered on a medium porosity glass frit funnel. The filtered solid on the funnel was washed with 100 mls. of room temperature methanol and after drying at 45°-50° C. in a vacuum oven (0.5 torr) overnight amounted to 76.4 grams (0.291 mole) of crude product (72.3% yield). Additional crude product was obtained by evaporating the reaction filtrate and washings to about half the original volume and an additional 8 grams of product precipitated and was removed by the above described filtration procedure. To this finally obtained filtrate was added an equal volume of distilled water and the precipitated solid was again vacuum filtered as above.

This solid was dissolved in 300 mls. methylene chloride and this solution was washed in a separatory funnel with an aqueous sodium bicarbonate solution consisting of 44 grams of the bicarbonate dissolved in 600 mls. of distilled water. The separated methylene chloride layer was finally washed with 200 mls. of of distilled water, and was then dried over anhydrous magnesium sulfate, was filtered and the filtrate retoevaporated to dryness to give an additional 8.6 grams of crude product. The three lots of crude product were combined (88% crude yield) into a 3-neck 100 ml. round bottom flask, and were vacuum distilled in a short path distillation using a heating tape. The distillate bulk (middle cut) amounted to 82.4 grams (0.314 mole-78% distilled yield) and boiled at 134°-5° C. at a pressure of about 10 mm Hg and a pot temperature of 146° C. The pure product which solidified while standing at room temperature overnight had a m.p. 45°-47° C., and was used directly in the above Ullmann condensation. The chemical reaction of the synethesis is described by the following:

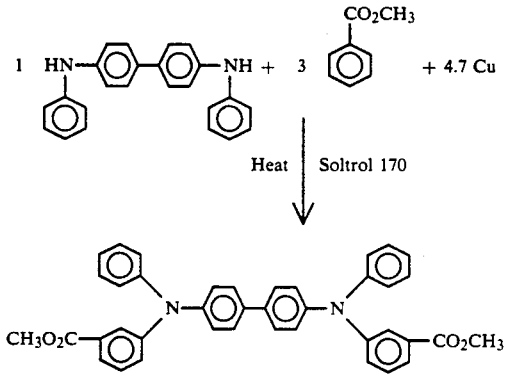

B. Melt Polycondensation Of N,N'-Diphenyl-N,N'-Bis(m-Dicarbomethoxyphenyl)Benzidine And 1,10-Decamethylene Gylcol This example uses decamethylene diol but the procedure is general for any difuncionally pure, i.e., (≧99%) aliphatic diol. Also, the dicarbomethoxy benzidine monomer may be p-disubstituted in addition to the m-disubstituted monomer used in this example. The p-disubstituted dicarbomethoxy benzidine monomer can be prepared using the analogous synthetic reactions described above for the corresponding meta disubstituted dicarbomethoxy benzidine monomer.

To a 100 ml. thick-walled resin kettle was charged 5.0 grams (8.3 mmoles) of the N,N'-diphenyl-N,N'-bis(m-dicarbomethoxyphenyl)benzidine prepared as described above, 3.03 grams (17.4 mmoles) of 1,10-decamethylene diol, and about 5-10 drops of Tyzor (tetraisopropoxy titanium, available from DuPont Co.). At least 2 moles of diol per mole of the dicarbomethoxybenzidine is required to effect the polycondensation to film forming molecular weight, but generally a 2.05 to 2.15 molar ratio was used. The resin kettle was assembled and the three outlet ports on the resin kettle head were equipped with a mechanical stirrer, an Argon inlet, and an Argon outlet to a flask that was used to collect the polycondensation by-products-methanol and 1,10-decamethylene diol. Optionally, the Argon outlet flask was equipped with a vacuum take-off for the later vacuum polycondensation stage applied in this process. The reaction contents were gently stirred while slowly purging with Argon for about 0.5 hour to remove the bulk of the adsorbed oxygen, and then a gentle Argon flow was maintained over the reaction contents in the initial non-vacuum polycondensation stage. This Argon flow assisted in the removal of methanol, the initial polycondensation by-product, which was removed in the lower temperature initial non-vacuum reaction stage. Heating was provided with a heating mantle controlled by a voltage regulated rheostat.

Typical polycondensation reaction conditions included slow mechanical stirring of the solid mixture throughout the polycondensation time period, and a temperature profile characteristic of most two stage melt polycondensation processes. In about 1-2 hours, the temperature was increased to 180°-210° C., during the earlier part of which time, droplets of methanol were observed exiting the reaction vessel. During the latter part of this initial polycondensation time period, a white solid began to deposit on the unheated portions of the resin kettle (head) signifying the onset of the second polycondensation step involving the elimination of the decamethylene diol. The reaction vessel contents now consisted of a light yellow bubbling melt. At this time, a moderate vacuum (3-5 mm of Hg) was applied to the resin kettle contents while the temperature was further increased to 210°-260° C., and this vacuum stage was applied for about 1-3 hours. After completing the vacuum stage, the vacuum line was replaced with an Argon purge and the heating mantle was removed. The thus cooled polymeric mass resolidified and was taken up in about 100 mls. of methylene chloride with overnight mechanical stirring. The methylene chloride solution was filtered to remove trace amounts of insolubles which occasionally formed, and the filtrate was dropped directly into about 1 liter of ethanol (any ethanol formulation is suitable) to give a fibrous appearing, generally colorless polymeric solid. The polymerization yield was about 60-80%. The coagulation solvent was decanted from the polymeric solid which was then dried overnight in vacuo at about 0.5 mm Hg and at 50°-60° C. to give the desired homopolymer. The process of chemical reaction is shown below:

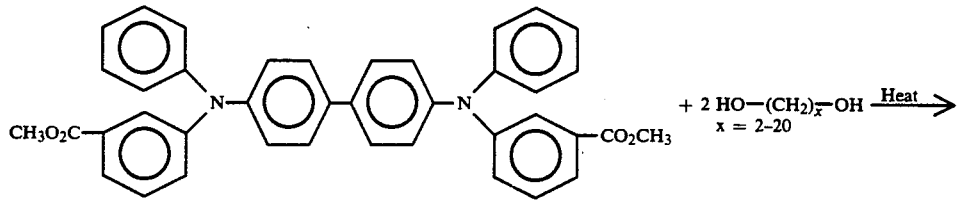

-continued

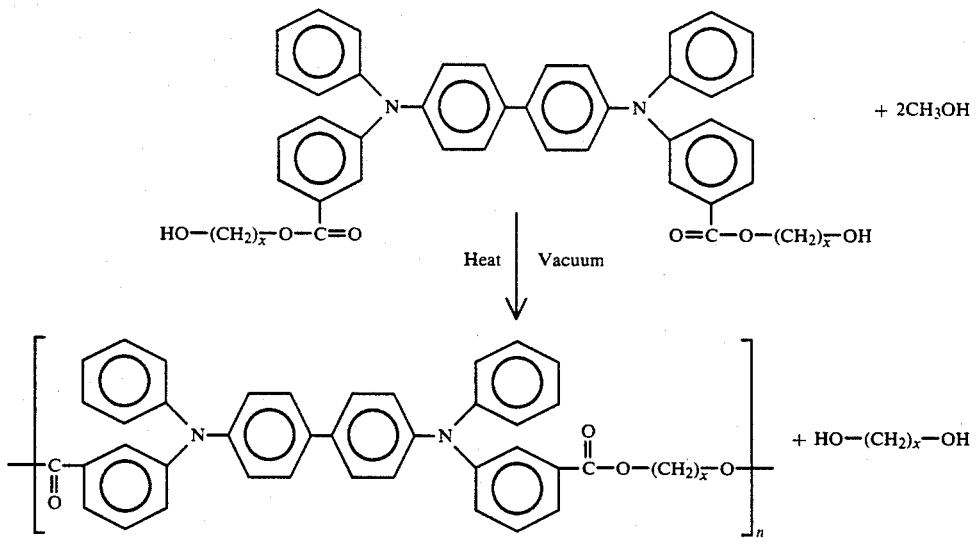

where n is the degree of polymerization and X is equal to 10 when using decamethylene diol for the synthesis.

COMPARATIVE EXAMPLE II

A control photoconductive imaging member was prepared by providing a titanium coated polyester (Melinex available from ICI Americas Inc.) substrate having a thickness of 3 mils, and applying thereto, using a gravure applicator, a solution containing 50 grams of 3-amino propyltriethoxy silane, 15 grams acetic acid, 684.8 grams of 200 proof denatured alcohol and 200 grams heptane. This layer was then dried for 10 minutes at 135° C. in a forced air oven. The resulting blocking layer had a dry thickness of 0.05 micrometer.

An adhesive interface layer was then prepared by applying a wet coating over the hold blocking layer, using a gravure applicator, containing 0.5 percent by weight based on the total weight of the solution of copolyester adhesive (DuPont 49,000, available from E.I. du Pont de Nemours & Co.) in a 70:30 volume ratio mixture of tetrahydrofuran/cyclohexanone. The adhesive interface layer was then dried for 10 minutes at 135° C. in a forced air oven. The resulting adhesive interface layer had a dry thickness of 0.05 micrometer.

The adhesive interface layer was thereafter coated with a photogenerating layer containing 7.5 percent by volume trigonal selenium, 25 percent by volume, N,N'-diphenyl-N,N'-bis(3-methylphenyl)-1,1'-biphenyl-4,4'-diamine, and 67.5 percent by volume polyvinylcarbazole. This photogeneraging layer was prepared by introducing 80 grams polyvinylcarbazole to 1400 ml of a 1:1 volume ratio of a mixture of tetrahydrofuran and toluene. To this solution were added 80 grams of trigonal selenium and 10,000 grams of ⅛ inch diameter stainless steel shot. This mixture was then placed on a ball mill for 72 to 96 hours. Subsequently, 500 grams of the resulting slurry were added to a solution of 36 grams of polyvinylcarbazole and 20 grams of N,N'-diphenyl-N,N'-bis(3-methylphenyl)-1,1'-biphenyl-4-4'-diamine in 750 ml of 1:1 volume ratio of tetrahydrofuran/toluene. This slurry was thereafter applied to the adhesive interface with an extrusion die to form a layer having a wet thickness of about 0.5 mil. However, a strip about 3 mm wide along one edge of the substrate, blocking layer and adhesive layer was deliberately left uncoated by any of the photogenerating layer material to facilitate adequate electrical contact by the ground strip layer that was applied later. This photogenerating layer was dried at 135° C. for 5 minutes in a forced air oven to form a photogenerating layer having a dry thickness of 2.3 micrometers.

This coated member was simultaneously layered over with a charge transport layer and a ground strip layer by coextrusion of the coating materials through adjacent extrusion dies similar to the dies described in U.S. Pat. No. 4,521,457.

The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon 5705, a polycarbonate resin having a molecule weight of from about 50,000 to 100,000 commercially available from Farbenfabricken Bayer A. G. The resulting mixture was dissolved by adding methylene chloride. This solution was applied on the photogenerator layer by extrusion to form a coating which upon drying has a thickness of 24 micrometers.

The strip, about 3 mm wide, left uncoated by the photogenerator layer was coextruded as a ground strip layer along with the charge transport layer. The ground strip layer coating mixture was prepared by combining 525 grams of polycarbonate resin (Makrolon 5705, available from Bayer AG), and 7,317 grams of methylene chloride in a carboy container. The container was tightly covered and placed on a roll mill for about 24 hours until the polycarbonate was dissolved in the methylene chloride. The resulting solution was mixed for 15–30 minutes with about 2,072 grams of a graphite dispersion (12.3 percent by weight solids) of 9.41 parts by weight graphite, 2.87 parts by weight ethyl cellulose and 87.7 parts by weight solvent (Acheson Graphite dispersion RW22790, available from Acheson Colloids Company) with the aid of a high shear blade disperser (Tekmar Dispax Disperser) in a water cooled, jacketed container to prevent the dispersion from overheating and losing solvent. The resulting dispersion was then filtered and the viscosity was adjusted to between 325-375 centipoises with the aid of methylene chloride. This ground strip layer coating mixture was then applied to the photoconductive imaging member to form an electrically conductive ground strip layer having a dried thickness of about 15 micrometers.

During the transport layer and ground strip layer coextrusion coating process, the humidity was equal to or less than 15 percent. The resulting photoreceptor device containing all of the above layers was annealed at 135° C. in a forced air oven for 6 minutes.

An anti-curl coating was prepared by combining 882 grams of polycarbonate resin (Makrolon 5705, available from Bayer AG), 9 grams of copolyester resin (Vitel-PE 100, available from Goodyear Tire and Rubber Co.), and 9,007 grams of methylene chloride in a carboy container to form a coating solution containing 8.9 percent solids. The container was tightly covered and placed on a roll mill for about 24 hours until the polycarbonate and polyester were dissolved in the methylene chloride. The anti-curl coating solution was then applied to the rear surface (side opposite the photogenerator layer and charge transport layer) of the photoconductive imaging member by extrusion coating and dried at 135° C. for about 5 minutes to produce a dried film having a thickness of 13.5 micrometers.

EXAMPLE III

A 9 inch×12 inch photoconductive imaging sample, without the ground strip layer, was cut from the imaging member of Example II and using a I-mil gap Bird applicator, an overcoating layer solution containing 10 grams of the polyester hompolymer of poly[oxydecamethyleneoxy-N,N'-diphenyl-N,N'bis(3-carbonylphenyl) benzidine] as described in Example I dissolved in 90 grams of methylene chloride was applied thereto. The resulting imaging sample having the wet overcoating was then allowed to dry for 5 minutes at 135° C. in a forced air oven. The dry overcoat thickness thus obtained was about 3.0 micrometers.

EXAMPLE IV

An overcoated photoconductive imaging sample was prepared in accordance with Example III, except that the homopolymer overcoating layer was applied with a 2-mil gap Bird application. The dry overcoat thickness obtained was about 6.0 micrometers.

EXAMPLE V

The overcoated photoconductive imaging samples of Examples III and IV were evaluated for overcoating layer adhesion strength to the underlying charge transport layer by an adhesive tape peel test. To prepare the samples for adhesion determination, a cross-hatched pattern was formed on each overcoated imaging sample by cutting through the thickness of the overcoating layer with a razor blade. The cross-hatched pattern consisted of perpendicular slices 5 millimeters apart to form tiny squares. A tape peel test was conducted with two different adhesive tapes: one was a ¾ inch width Scotch Brand Magic Tape No. 810, available from 3M Corporation, and the other was a ½ inch width Fas Tape No. 445, available from Fasson Industrial Division, Avery International. The adhesive tapes of each manufacturer were pressed onto the surface of each test sample and each tape was then peeled at a 90° angle away from the surface of the overcoated imaging samples. Peeling off the tapes from the imaging test samples did not remove any of the cross-hatched pattern, thus indicating good bonding strength had been formed between the overcoating and the charge transport layer.

EXAMPLE VI

The fabricated photoconductive imaging members of Examples II to IV were tested for liquid developer compatibility. The liquid xerographic ink contained pigment material dispersed in a mineral oil liquid carrier. The reaction of each imaging member to the combination of stress and ink exposure was tested by static-bend parking on a 2-inch width imaging member sample over a 19mm diameter roll to induce a high bending stress at the surface of the imaging sample while a cotton swab saturated with ink rested on top of the bent section of the imaging member sample to provide ink plus imaging member sample contact. The ink/sample stress surface cracking as well as hole transport compound leaching/crystalline were first notable after only 45 minutes of testing for the control imaging sample having no protective overcoating. Each of the overcoated test samples was examined for surface cracking daily using a reflection optical microscope at 100×magnification. The low volatility of the mineral oil carrier liquid in the ink coupled with the capillary action of the cotton swab provided an abundant ink supply to ensure constant ink/sample contact during 23 days of stress-/ink exposure testing. The invention overcoating of having either 3 or 6 micrometers thickness was seen to be efficient in acting as a barrier to protect the underlying charge transport layer from ink/stress induced cracking and hole transport compound leaching/crystallization in the entire duration of testing.

The same testing procedures were repeated for each virgin imaging member sample but with each of the oil carrier liquids, used in various ink formulations, such as Mineral Oil (available from Shell Chemicals Company), Magiesol (available from Magie Oil Company), and Isopar L (available from Exxon Company). No imaging member/oil induced overcoat/charge transport layer surface cracking was noted for each of the samples after 23 days of exposure testing, indicating good material-/ink compatibility of the polyester homopolymer overcoated photoconductive imaging members of the present invention.

EXAMPLE VII

The electrical properties of the photoconductive imaging samples prepared according to Examples II, III and IV were evaluated with a xerographic testing scanner comprising a cylindrical aluminum drum having a diamerer of 9.55 inches. The test samples were taped onto the drum. When set to rotation, the drum which carried the samples produced a constant surface speed of 30 inches per second. A direct current pin corotron, exposure light, erase light and five electrometer probes were mounted around the periphery of the mounted photoreceptor samples. The sample charging time is 33 milliseconds. Both exposed and erased light were broad band white light (400–700 nm) outputs, each supplied by a 300 watt output Xenon arc lamp. The relative locations of the probes and lights are indicated in Table I below:

TABLE I

| ELEMENT | ANGLE (Degrees) | POSITION | DISTANCE FROM PHOTORECEPTOR |
|---|---|---|---|
| CHARGE | 0 | 0 | 18 mm (Pins)<br>12 mm (Shield) |
| Probe 1 | 22.50 | 47.9 mm | 3.17 mm |
| Expose | 56.25 | 118.8 | N.A. |
| Probe 2 | 78.75 | 166.8 | 3.17 mm |

TABLE I-continued

| ELEMENT | ANGLE (Degrees) | POSITION | DISTANCE FROM PHOTORECEPTOR |
|---|---|---|---|
| Probe 3 | 168.75 | 356.0 | 3.17 mm |
| Probe 4 | 236.25 | 489.0 | 3.17 mm |
| Erase | 258.75 | 548.0 | 125 mm |
| Probe 5 | 303.75 | 642.9 | 3.17 mm |

The test samples were first rested in the dark for at least 60 minutes to ensure achievement of equilibrium with the testing conditions at 40% relative humidity and 21° C. Each sample was then negatively charged in the dark to a development potential of about 900 volts. The charge acceptance of each sample and its residual potential after discharge by front erase exposure to 400 ergs/cm$^2$ of light exposure were recorded. The test procedure was repeated to determine the photo induced discharge characteristic (PIDC) of each sample by different light energies of up to 20 ergs/cm$^2$.

50,000 cycles electric results obtained for the test samples of Examples II, III, and IV gave equivalent dark decay potential, background voltage, the extent of electrical cycle down after 50,000 cycles of testing, and photo-induced discharge characteristics curves. These electrical cyclic results are of particular importance because they indicate that overcoating the charge transport layer with 3 to 6 micrometers of polyester homopolyer of the present invention not only provided the desired effect of protecting the charge transport layer against ink and solvent ink carrier attack, while that of crucial electrical integrity of the control photoconductive imaging member was also maintained.

EXAMPLE VIII

A 10.3 inches × 16.2 inches photoconductive imaging sample having a ground strip layer was cut from the imaging member of Example II and overcoated with 5.2 micrometers dry thickness layer of polyester homopolymer of Example I. The application of the overcoat was achieved by spraying a 3 weight percent solution, containing the polyester homopolymer dissolved in a 60:40 ratio of methylene chloride:1,1,2 trichloroethane solvent mixture, over the imaging sample. The overcoated wet film was dried for 5 minutes at 135° C., and the resulting imaging sample was then ultrasonically welded into a photoreceptor belt. The fabricated photoreceptor belt is tested in a Xerographic machine using a liquid ink system, and gives good electrical performance and print quality. No charge transport compound leaching/crystallization/charge transport layer cracking were evident after 500 cycles of xerographic imaging function.

What is claimed is:

1. An electrophotographic imaging member comprising a charge transport layer and an overcoating layer, said overcoat layer comprising a single component hole transporting polyester homopolymer comprising a hole transport compound and an aliphatic diol in the polymer chain backbone, and wherein said overcoat layer is of a thickness which prevents crystallization and leaching of hole transport compound in said charge transport layer upon exposure to liquid xerographic ink and ink solvent carriers.

2. The electrophotographic imaging member of claim 1 wherein said overcoat layer has a thickness of from about 2 to about 10 micrometers.

3. The electrophotographic imaging member of claim 2 wherein said overcoat layer has a thickness of from about 3 to about 6 micrometers.

4. The electrophotographic imaging member of claim 3 wherein said overcoat layer comprises a meta hole transport compound ester linkage polyester homopolymer having the general molecular formula:

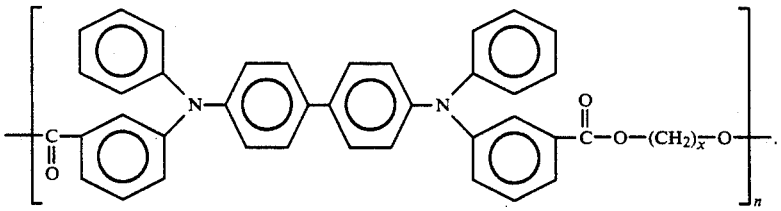

5. The electrophotographic imaging member of claim 4 wherein said polyester homopolymer has 2 to 20 repeating $CH_2$ units in the chain backbone.

6. The electrophotographic imaging member of claim 5 wherein said polyester homopolymer has the molecular formula:

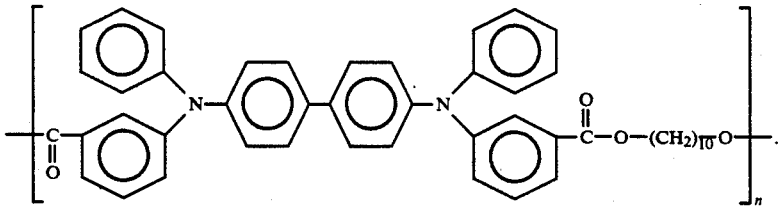

7. The electrophotographic imaging member of claim 3 wherein said polyester homopolymer overcoat layer comprises a para hole transport compound ester linkage polyester homopolymer having the general molecular formula:

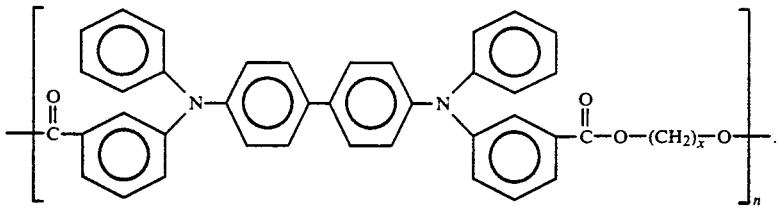

8. The electrophotographic imaging member of claim 7 wherein said polyester homopolymer overcoat has 2 to 20 repeating $CH_2$ units in the chain backbone.

9. The electrophotographic imaging member of claim 8 wherein said polyester homopolymer has the molecular formula:

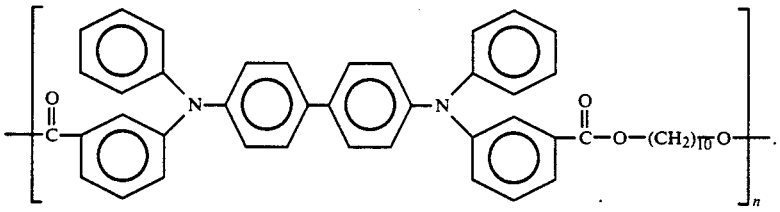

10. An electrophotographic imaging member comprising:

a supporting substrate;

a charge generating layer;

a charge transport layer; and an overcoat layer comprising a single component hole transporting polyester homopolymer, wherein said polyester homopolymer comprises a hole transporting compound and an aliphatic diol in the polymer chain backbone, wherein said overcoat layer is of a thickness which prevents crystallization and leaching of hole transport compound in said charge transport layer upon exposure to liquid zerographic ink and ink solvent carriers.

11. The electrophotographic imaging member of claim 10 wherein said overcoat layer has a thickness of from about 2 to about 10 micrometers.

12. The electrophotographic imaging member of claim 11 wherein said overcoat layer has a thickness of from about 3 to about 6 micrometers.

13. The electrophotographic imaging member of claim 12 wherein said polyester homopolymer comprises a meta hole transport compound ester linkage polyester homopolymer having the general molecular formula:

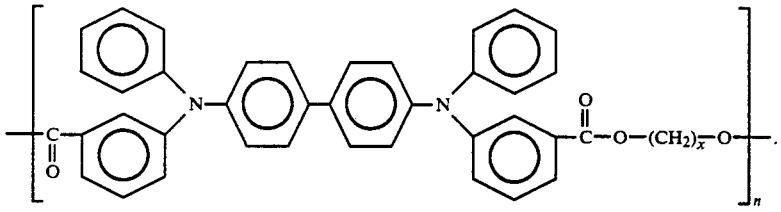

14. The electrophotographic imaging member of claim 13 wherein said polyester homopolymer has 2 to 20 repeating $CH_2$ units in the chain backbone.

15. The electrophotographic imaging member of claim 14 wherein said polyester homopolymer has the molecular formula:

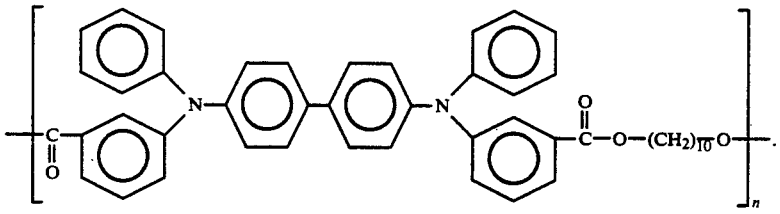

16. The electrophotographic imaging member of claim 12 wherein said polyester homopolymer comprises a para hole transport compound ester linkage polyester homopolymer having the general molecular formula:

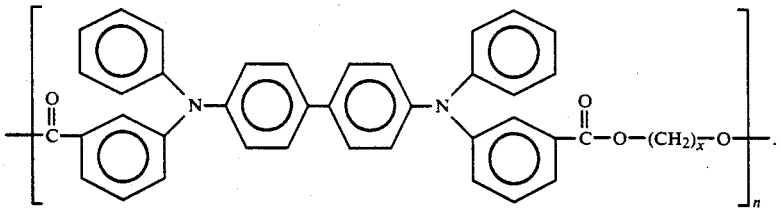

17. The electrophotographic imaging member of claim 16 wherein said polyester homopolymer has 2 to 20 repeating $CH_2$ units in the chain backbone.

18. The electrophotographic imaging member of claim 17 wherein said polyester homopolymer has the molecular formula:

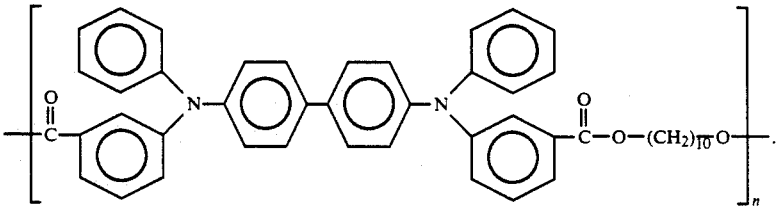

19. An electrographic imaging member comprising a charge transport layer and an overcoat layer, said overcoat layer comprising a polymer selected from the group consisting of a copolymer of a hole transport compound linked to a urethane, a fluorine-based pendant active moiety functional polymer of a polyester, a fluorine-based pendant active moiety functional polymer of a polycarbonate, a fluorine-based pendant active moiety functional polymer of a polyurethane, and an organo-polyphosphazene having hole transport pendant groups, and wherein said overcoat layer is of a thickness which prevents crystallization and leaching of hole transport compound in said charge transport layer upon exposure to liquid zerographic ink and ink solvent carriers.

* * * * *

UNITED STATES PATENT AND TRADEMARK OFFICE

CERTIFICATE OF CORRECTION

PATENT NO. : 5,149,609
DATED : September 22, 1992
INVENTOR(S) : Robert C. U. YU et al.

It is certified that error appears in the above-indentified patent and that said Letters Patent is hereby corrected as shown below:

| Column | Line | |
|---|---|---|
| 1 | 55 | After "transparent" insert --and--. |
| 2 | 12 | Change "diameters" to --diameter--. |
| 3 | 13 | Change "...Si()$CH_3)_2$" to --...Si($OCH_3)_2$--. |
| 4 | 4 | Change "pyrolidone" to --pyrrolidone--. |
| 4 | 53 | After "preferred" insert --because--. |
| 5 | 66 | Change "preferable" to --preferably--. |
| 8 | 4 | After "one" change "of" to --or--. |
| 8 | 37 | Change "comprise" to --be comprised--. |
| 9 | 9 | Before "adhesive" change "a" to --an--. |
| 9 | 59 | Change "effect" to --affect--. |
| 10 | 26 | Change "4,I8I,526" to --4,181,526--. |
| 13 | 36 | Change "water-colled" to --water-cooled-- |
| 14 | 52 | Change "coloress" to --colorless--. |

UNITED STATES PATENT AND TRADEMARK OFFICE

CERTIFICATE OF CORRECTION

PATENT NO. : 5,149,609
DATED : September 22, 1992
INVENTOR(S) : Robert C. U. YU et al.

It is certified that error appears in the above-indentified patent and that said Letters Patent is hereby corrected as shown below:

| Column | Line | |
|---|---|---|
| 15 | 5 | Change "retoevaporated" to --retroevaporated--. |
| 15 | 39 | Change "difuncionally" to --difunctionally--. |
| 17 | 53 | Change "photogeneraging" to --photogenerating--. |
| 19 | 28 | Change "I-mil" to --1-mil--. |
| 19 | 30 | Change "hompolymer" to --homopolymer--. |
| 20 | 49 | Change "diamerer" to --diameter--. |
| 22 | 13 | Change "overcoating" to --overcoat--. |

Signed and Sealed this

Fifteenth Day of March, 1994

*Attest:*

*Attesting Officer*

BRUCE LEHMAN

*Commissioner of Patents and Trademarks*